United States Patent [19]

Goto et al.

[11] Patent Number: 4,601,463

[45] Date of Patent: Jul. 22, 1986

[54] CLOTH GRIPPING DEVICE

[75] Inventors: Hidetaka Goto; Tetsuo Nakamura, both of Ohno, Japan

[73] Assignee: Matsuya Hoseikiki Hanbai Kabushiki Kaisha, Ohno, Japan

[21] Appl. No.: 627,468

[22] Filed: Jul. 3, 1984

[51] Int. Cl.[4] ..... B65H 3/22; B65H 3/54

[52] U.S. Cl. ..... 271/19; 271/18.3

[58] Field of Search ..... 271/19, 20, 161, 18.3, 271/21, 22, 23, 24, 25; 221/210; 294/103 R

[56] References Cited

U.S. PATENT DOCUMENTS

| | | | |
|---|---|---|---|
| 3,253,824 | 5/1966 | Southwell et al. | 271/19 |
| 3,813,094 | 5/1974 | Walton et al. | 271/19 |
| 4,346,877 | 8/1982 | Doyen et al. | 271/19 |

*Primary Examiner*—Duane A. Reger
*Assistant Examiner*—Lawrence J. Goffney, Jr.
*Attorney, Agent, or Firm*—Birch, Stewart, Kolasch & Birch

[57] ABSTRACT

A cloth gripping device including a pressing member having a portion for pressing a cloth to grip the same and a claw member for cooperating with the pressing member to grip the cloth therebetween. A pressing face is formed on the bottom of the pressing member for pressing the cloth. A retracted face is located at a position retracted by a distance corresponding to the thickness of a single cloth from the pressing face relative to the cloth. A substantially vertical gripping wall is provided by a step between the pressing face and the retracted face. A gripping groove is formed which is sufficiently wide but not too wide to receive a bent portion of the cloth therein when only one cloth is picked up adjacent a boundary between the pressing face and the retracted face. The retracted face includes a guide groove formed therein for guiding the claw member toward the gripping groove. The claw member is disposed for reciprocal movement in a direction toward the gripping wall along the guide groove whereby only one cloth can be gripped between the claw member and the gripping wall.

5 Claims, 10 Drawing Figures

CLOTH GRIPPING DEVICE

BACKGROUND OF THE INVENTION

Field of the Invention

This invention relates to a cloth gripping device for ensuring the pick up and gripping of only a single piece of cloth. More particularly, to a cloth gripping device which includes a cloth pressing member constituting a portion for pressing a cloth to grip the cloth so as not to allow movement of the cloth, and a claw member disposed for reciprocal movement and cooperating with the cloth pressing member to pick up and grip only one cloth therebetween. With the cloth gripping device, cloths can be assuredly gripped one by one without being damaged. Accordingly, the cloth gripping device is very effective when cloths accumulated in a pile are to be gripped one after another from the top of the pile and moved to a different desired location.

SUMMARY AND OBJECTS OF THE INVENTION

It is necessary in various operations to grip and move one cloth after another to a desired location. Movement of cloth is one of the essential steps particularly for automation in the apparel industry. Above all in a sewing process, a gripping machine is expected to grip one piece of cloth after another from a pile of cloths and supply them to a sewing machine. Various methods and devices have been developed for gripping cloth. Principally, they include (1) a method and device which employs a reciprocating member having a needle thereon for piercing one piece of cloth after another in order to move the cloths; and (2) another method and device which employs a cloth pressing member and a claw member for nipping a cloth therebetween in order to move the cloth. However, according to the former method and device, cloths are damaged. In addition, it is difficult for the needle to pierce only one cloth thus errors in operation frequently occur wherein two or three cloths are supplied at once. On the other hand, according to the latter method and device, cloths do not suffer from damage, but it is also difficult for the cloth pressing member and the claw member to cooperatively grip only one cloth therebetween. Thus, it frequently occurs that the gripping machine grips two or three cloths at once therebetween.

It is an object of the present invention to provide a cloth gripping device which can ensure the gripping and movement of only a single cloth without damaging the cloth. The present invention provides, particularly, a cloth gripping device which can ensure the pick up and nipping of one cloth after another from the top of a pile of such cloths.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
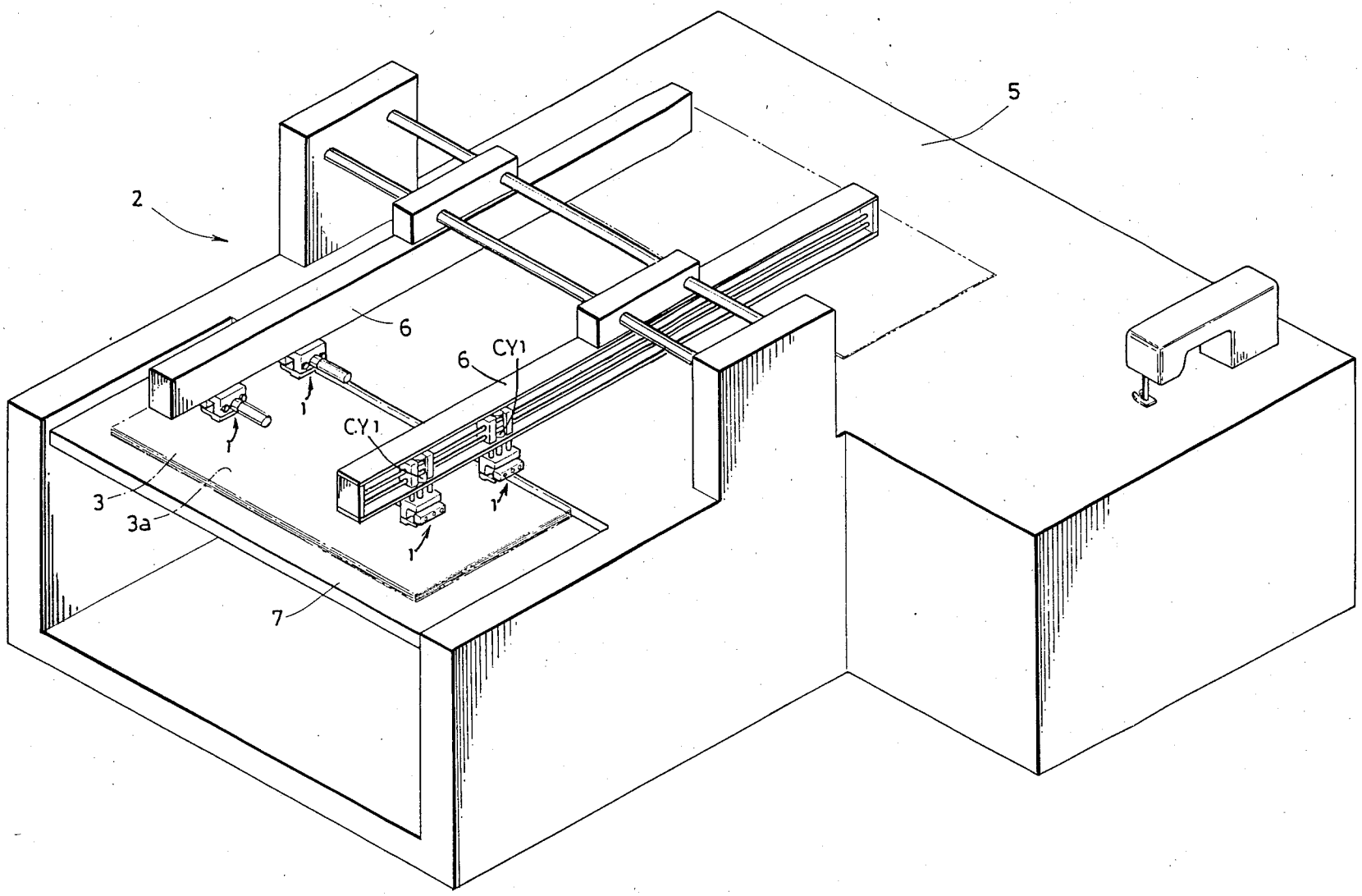
FIG. 1 is a perspective view showing a cloth supply apparatus to which a cloth pressing member according to the present invention is applied.

A cloth gripping device according to the present invention includes two members one of which is a cloth pressing member constituting a portion for pressing a cloth to grip the cloth so as not to allow movement of the cloth while the other member is a claw member which cooperates with the cloth pressing member to pick up and nip a cloth therebetween. On a bottom portion of the pressing member a pressing face is formed for pressing a cloth. A retracted face is located at a position displaced by a distance corresponding to the thickness of a single cloth from a face of the cloth so that the cloth may not be moved freely even when the pressing face presses against the cloth. A substantially vertical gripping wall is provided by a step between the pressing face and the retracted face. A gripping groove is formed along a boundary portion between the pressing face and the retracted face wherein the gripping groove is sufficiently wide but not too wide to receive a bent portion of the cloth therein when only one cloth is picked up. The retracted face has a guide groove formed therein for guiding the claw member in a direction toward the gripping groove.

In the meantime, the claw member is fitted in the guide groove and is arranged such that it is reciprocally moved in a direction toward the gripping wall along the guide groove by means of a driving member.

With the cloth gripping device having such a construction as described hereinabove, the entire device is lowered from above a pile of cloths and presses against the pile of cloths. After the device has been lowered to a position in which a pressing force is obtained which is sufficient to allow no movement of the cloths even if the claw member is moved, the lowering movement of the device is stopped and then the driving device is rendered operative to move the claw member in the direction toward the gripping face along the guide groove. Since the claw of the claw member protrudes below the retracted face, that is, in a direction toward the cloths, it is contacted with one of the cloths located at the top of the pile and moves only the uppermost one cloth in the direction toward the gripping wall, that is, toward the pressing face. In order to then allow such movement of only one cloth located at the top of the pile and prevent movement of any of the remaining cloths of the pile, it is necessary that the retracted face is located in a position retracted by a distance corresponding to the thickness of a cloth from the position of the pressing face. It is a very important requisition that the retracted face has a gripping groove formed therein which is sufficiently wide but not too wide to receive a bent portion of the cloth therein when only one cloth is picked up and bent or folded.

According to the invention, the retracted face and the gripping groove are designed to meet such requirements as described above so that only an uppermost one of a pile of cloths is moved in the direction toward the gripping wall and a portion thereof which is caused to swell upwardly by this movement is bent or folded on itself and is received in the gripping groove. Thus, the object of the invention is attained if the claw presses the portion of the cloth thus bent against the gripping wall to grip the cloth and then in this condition the entire cloth gripping device is moved to a desired location.

An embodiment of the present invention in which a cloth gripping device is used for supplying a pile of cloths one by one to a sewing station of a sewing machine is described hereinbelow.

Referring to FIG. 1, a cloth supplying apparatus 2 is illustrated which picks up cloths 3 one after another from the top 3*a* of a pile of cloths 3 placed in a piled up relationship and supplies the cloth to a sewing machine table 5. The cloth supplying apparatus 2 includes a pair of guide cases 6 which extend in an elongated configuration from above a cloth supporting table 7, for supporting the pile of the cloths 3 thereon, to above and over the sewing machine table 5. A cloth gripping device or devices 1, according to the present invention, may be mounted on the guide cases 6 for providing traveling movement between the opposite ends of the guide cases 6. Thus, each of the guide cases 6 has a pair of cloth gripping devices 1 mounted thereon in a spaced relationship determined in accordance with a width of the cloths used such that the two pairs of the cloth gripping devices 1 may grip the cloth 3*a* which is then positioned on the top of the pile of the cloths 3.

Figure 2:
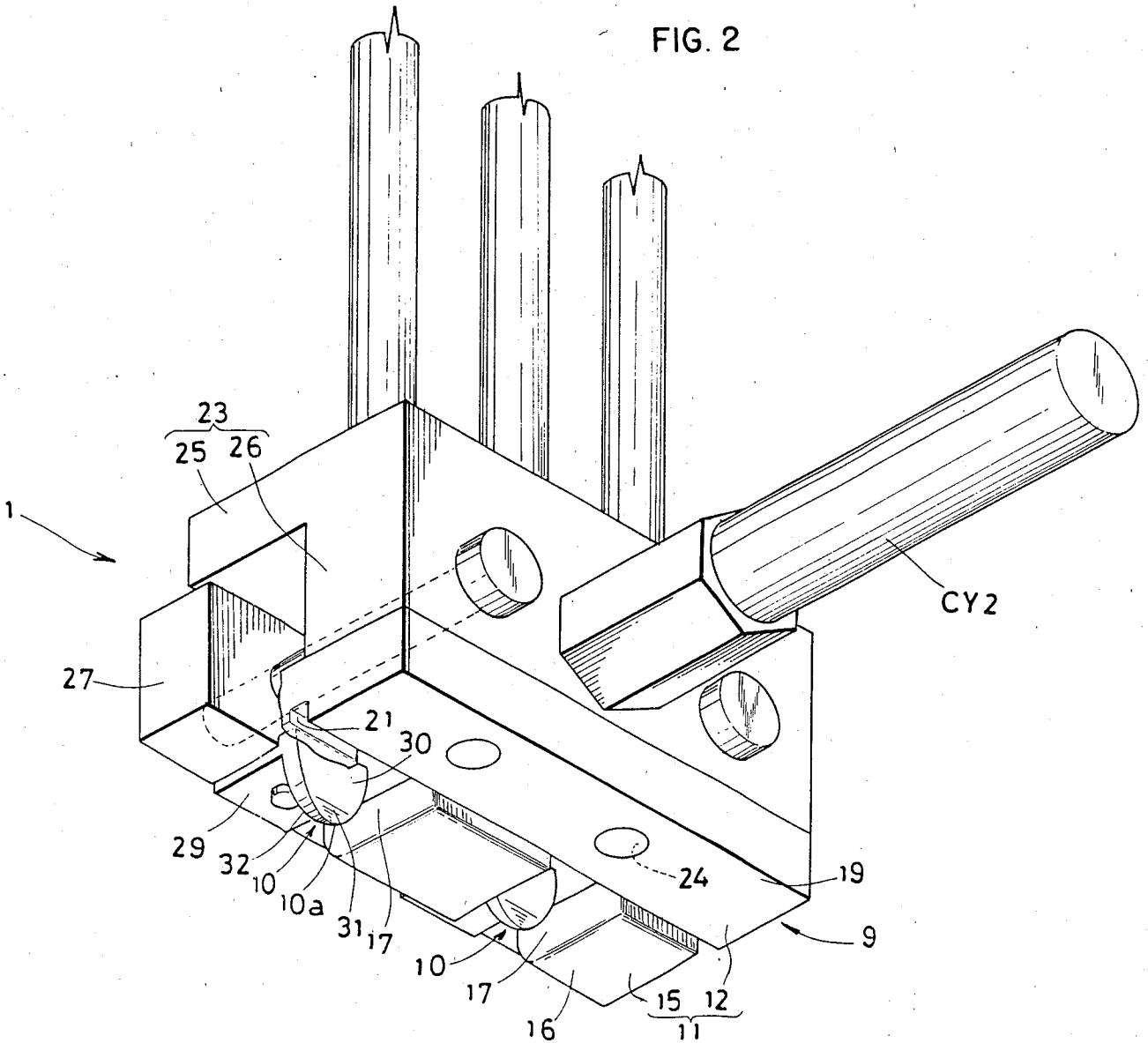
FIG. 2 is a perspective view showing an embodiment of the present invention.

FIG. 2 is a perspective view showing an embodiment of the cloth gripping device 1 of the present invention. Referring to FIG. 2, the cloth gripping device 1 includes a cloth pressing member 9 and a pair of claw members 10.

Figure 3:
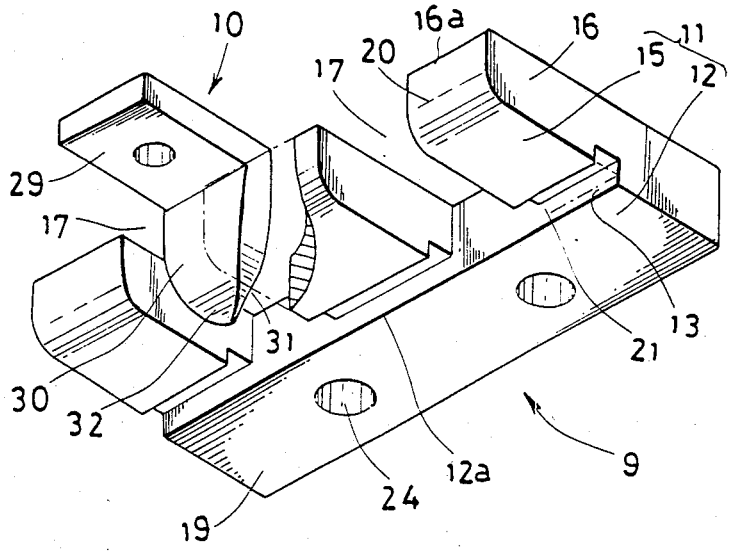
FIG. 3 is a perspective view illustrating a cloth pressing member and a claw member.
Figure 4:
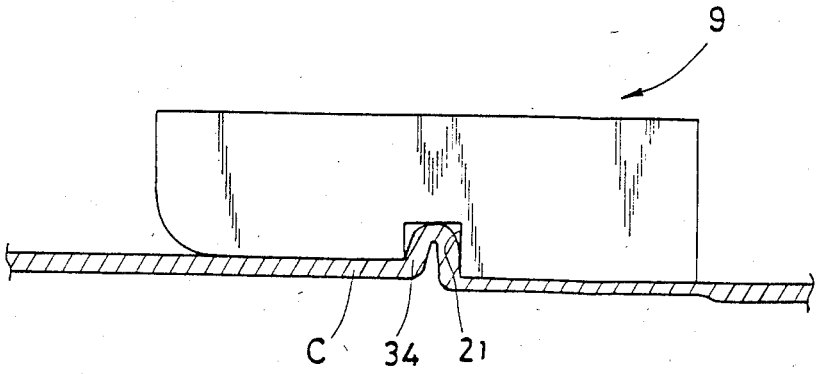
FIG. 4 is a side elevational view showing a cloth received in a gripping groove of the cloth pressing member.
Figure 5A:
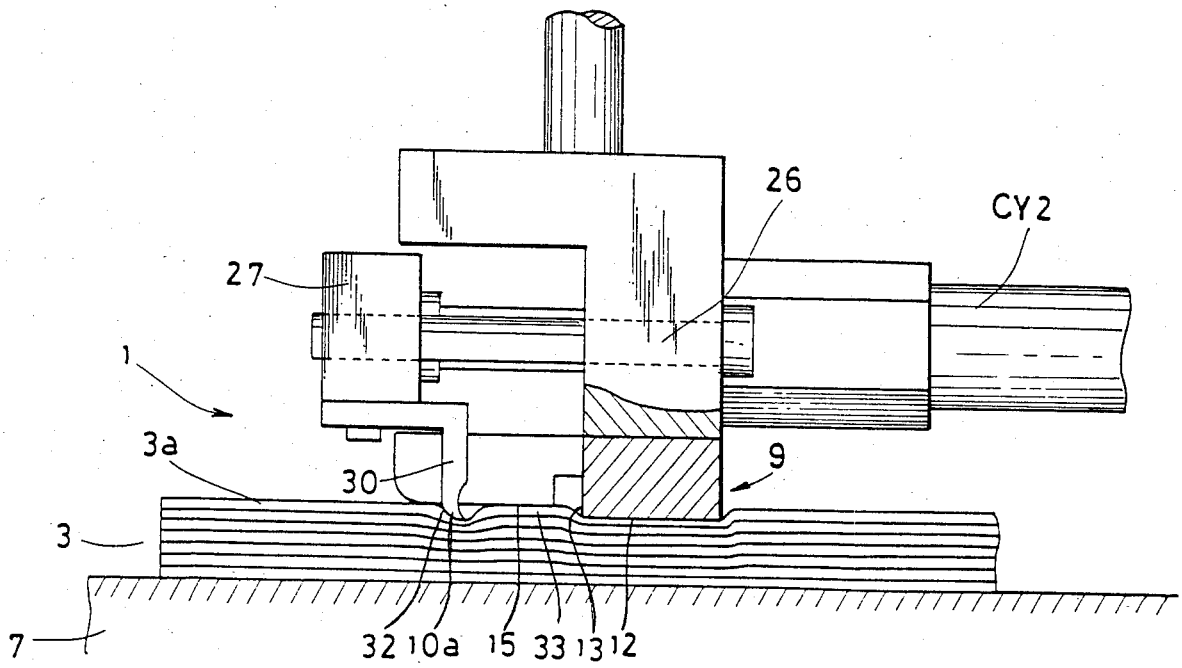
FIGS. 5(*a*) and 5(*d*) are partial side elevational cross-sectional views illustrating operations of the cloth gripping member of the present invention.
Figure 5B:
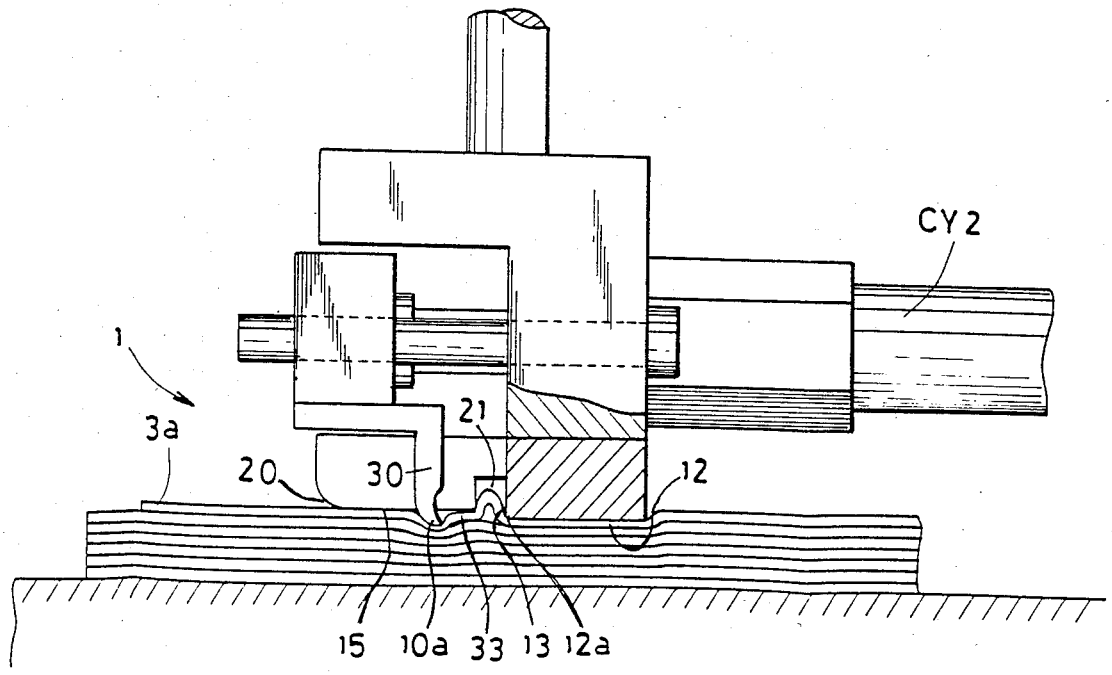
Figure 5C:
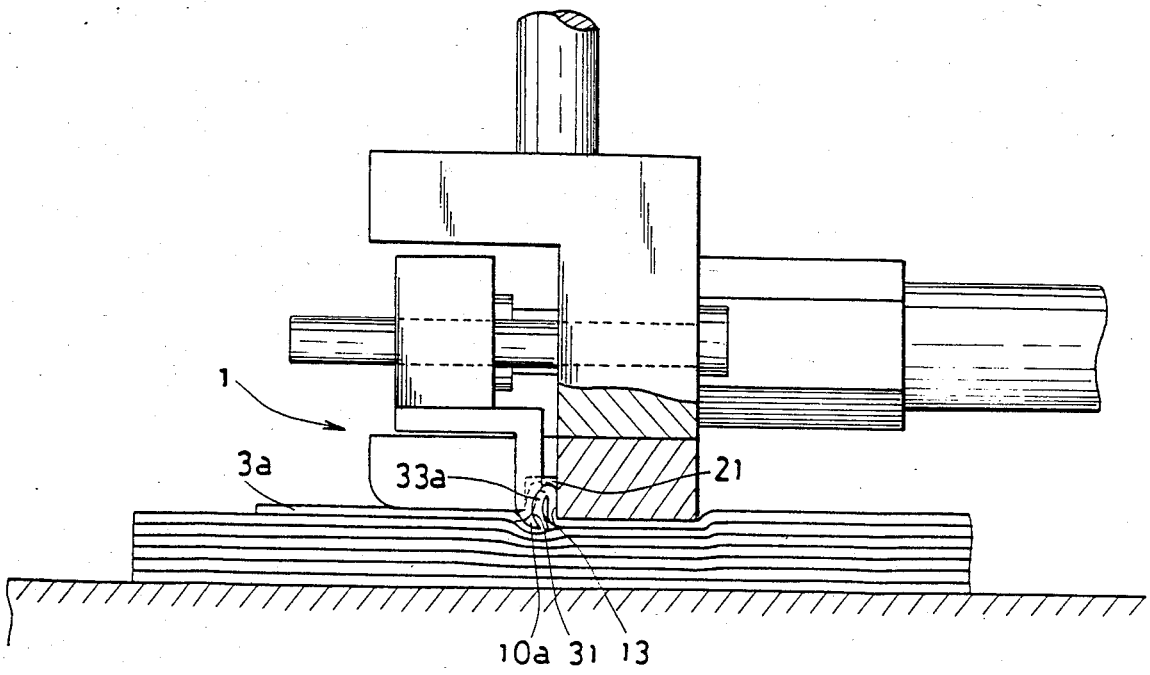
Figure 5D:
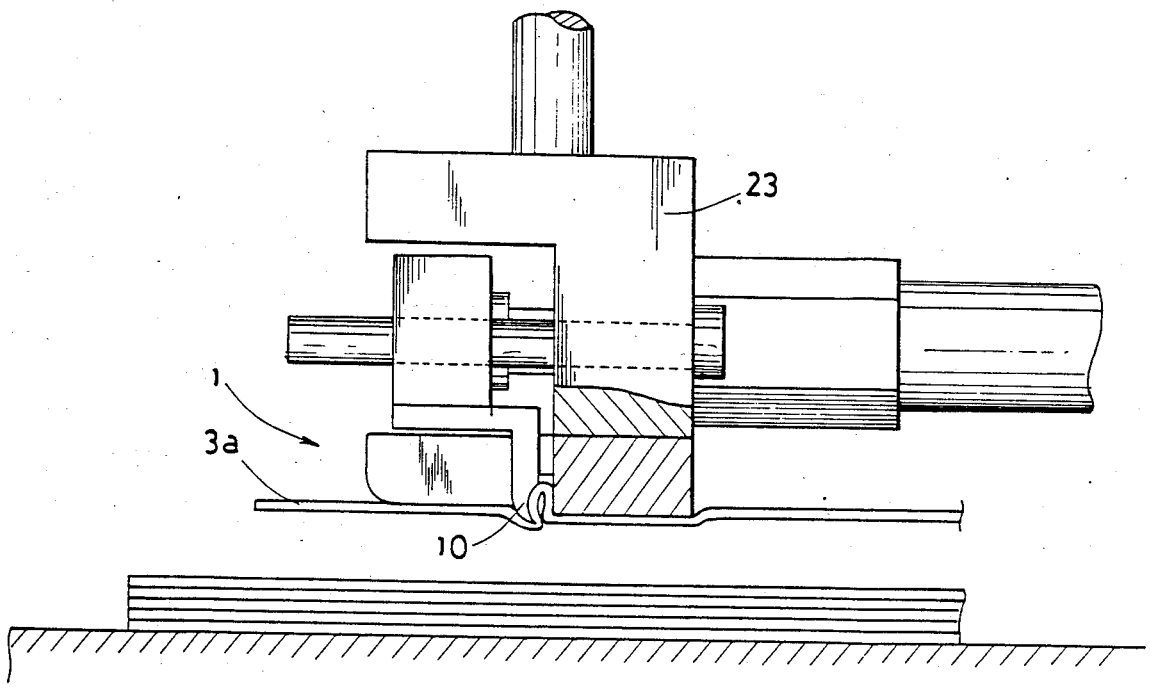

The cloth pressing member 9 has a generally comb-like configuration as shown in FIG. 3 and has a bottom face 11 for pressing against a surface of a cloth. The bottom face 11 is divided into two sections including a rectangular pressing face 12 presenting a linear longitudinal edge 12*a* and a plurality of, that is, three, retracted faces 15 which are retracted or offset upwardly from the pressing face 12 by a distance substantially equal to a thickness of the cloth used. The retracted faces 15 are each finished to have a smooth surface and are provided individually on retracted sections 16 which define, between adjacent ones thereof, a pair of rectangular guide grooves 17 extending in a direction perpendicular to a gripping wall 13 from end borders 16*a* of the retracted sections 16 to the gripping wall 13. Thus, the retracted sections 16 extend in a comb-like configuration from a pressing section 19 on which the pressing face 12 is provided. Each of the retracted sections 16 has an arcuately curved face 20 on the bottom adjacent the end border 16*a* thereof and also has a channel-shaped gripping groove 21 formed in a portion adjacent the opposite border thereof adjacent the pressing face 12 and extending along the full length of the border. The gripping groove 21, as illustrated in FIG. 4, is formed to have a width about twice the thickness of a cloth 3 so that only one cloth 3 may be received in its folded form therein while it has a depth sufficient to allow a single cloth 3 to be folded on itself within the gripping groove 21.

As shown in FIG. 2, the cloth pressing member 9 is secured to an inverted L-shaped securing member 23 which is moved up and down by an expanding and contracting operation of an air cylinder CY1 (which is shown in FIG. 1). In particular, the cloth pressing member 9 is secured to a depending section 26 of the securing member 23 by means of bolts extending through bolt holes 24 formed therein such that the retracted sections 16 thereof are opposed to a horizontal section 25 of the securing member 23 while the top face of the pressing section 19 thereof is contacted with the bottom end face of the depending section 26 of the securing member 23. A reciprocating member 27 is disposed between the horizontal section 25 of the securing member 23 and the retracted sections 16 of the cloth pressing member 9 and is moved toward and away from the depending section 26 of the securing member 23 by an expanding and contracting operation of another air cylinder CY2 which is fixedly mounted on the depending section 26.

As shown in FIGS. 2 and 3, each of the claw members 10 has a mounting section 29 located in the guide groove 17. The mounting section 29 is screwed onto the bottom face of the reciprocating member 27. The claw member 10 further includes a claw section 30 depending from an end of the mounting section 29 adjacent to the pressing section 19 of the cloth pressing member 9. The claw section 30 of the claw member 10 is located in the guide groove 17 so that it can be moved toward and away from the gripping wall 13 of the cloth pressing member 9 in and along the guide groove 17 as the reciprocating member 27 is moved back and forth. The claw section 30 of the claw member 10 is narrowed gradually toward the bottom end thereof and presents a rounded configuration at a lower end portion thereof, that is, at a lower end portion 10*a* of the claw member 10. A face of the lower end portion 10*a* of the claw member 10 adjacent the pressing section 19 of the cloth pressing member 9, that is, a front face of the portion 10*a*, is formed as a curved rake face 31 while the opposite or rear face is formed as a relief face 32. The length of the claw section 30 of the claw member 10 is determined such that the claw section 30 protrudes at the lower end thereof slightly below the pressing face 12 of the cloth pressing member 9 (that is, by a distance which is substantially one half of the thickness of a single cloth 3). It is to be noted here that the air cylinder CY2 is normally in its expanded position, and in the expanded position of the air cylinder CY2, the reciprocating member 27 is positioned relative to the depending section 26 of the securing member 23 such that a distance between the lower end portion 10*a* of the claw member 10 and the gripping wall 13 of the cloth pressing member 9 is substantially equal to or a little greater than the length of a folded portion 34 of the cloth shown in FIG. 4.

The operation of the cloth gripping device 1 of the present invention will now be described with reference to FIGS. 5(*a*) to 5(*d*). At first, the air cylinder CY1 for the cloth gripping device 1 is operated to expand itself to lower the cloth pressing members 9 toward an uppermost one 3*a* of the cloths 3 placed in a piled up condition on the cloth supporting table 7 until the pile of the cloths 3 is pressed by the pressing face 12 of the cloth pressing member 9 and is thus compressed or sunk into the pile by an amount corresponding to the thickness of a single cloth as shown in FIG. 5(*a*). In this position, the uppermost cloth 3*a* is lightly contacted at predetermined portions thereof with the retracted faces 15 of the cloth pressing member 9 while it is pressed at some other portions thereof by the pressing face 12 of the cloth pressing member 9 so that it is immovably secured thereby. Meanwhile, the lower end portions 10*a* of the claw members 10 locally push down and bite the uppermost cloth 3*a*.

Subsequently, the air cylinder CY2 is operated. to contract itself to gradually advance the reciprocating member 27 toward the depending section 26 of the securing member 23. By this movement of the reciprocating member 27, the claw members 10 are also advanced toward the gripping wall 13 of the cloth pressing member 9 so that the claw sections 30 thereof move a portion 33 of the cloth to be folded, which is positioned between the claw sections 30, and the gripping wall 13 over the entire width of the retracted faces 15 toward the gripping wall 13. It is to be noted that the movement of the cloth portion 33 to be folded is very smooth since the cloth portion 33 is in a condition wherein the cloth is lightly contacted with the retracted faces 15 on opposite sides of each of the claw sections 30 and the retracted faces 15 are finished into smooth faces as described above. It is also to be noted that, since in the present embodiment the bottom faces adjacent the end borders 16*a* of the retracted sections 16 are formed into arcuate faces 20, the cloth portion 33 to be folded can move more smoothly without being hindered from moving by the retracted sections 16. In addition, since the rear faces of the lower end portions of the claw sections 30 are formed into curved relief faces 32, the lower end portions 10*a* of the claw members 10 can bite into the cloth 3*a* more easily, making the movement of the cloth 3*a* more reliable. It is further to be noted that since the lower end portions 10*a* of the claw members 10 present an arcuate configuration, there is no fear of damage to the cloth 3*a* by biting the lower end portions 10*a* into the cloth 3*a*.

Since the cloth 3*a* is securely held from movement by the pressing face 12 as described hereinabove, as the cloth portion 33 to be folded is moved, it is folded from a portion thereof adjacent a side edge 12*a* of the pressing face 12 and is thus admitted or received gradually into the gripping grooves 21.

When the cloth portion 33 is received in its fully folded condition in the gripping groove 21 as shown in FIG. 5(*c*), a portion 33*a* of the cloth portion 33 within the guide groove 17 is firmly gripped between the gripping wall 13 and the lower end portions 10*a* of the claw members 10. Since the rake faces 31 at the lower ends of the claw sections 30 of the claw members 10 of the present invention are formed as curved faces, the cloth portion 33*a* is smoothly folded into a loop-like configuration along the rake faces 31. As a result, the cloth 3*a* can be gripped assuredly without any difficulty.

Thus, the cloth 3*a* is gripped at four corners thereof by the cloth gripping devices 1. If the securing members 23 are lifted as shown in FIG. 5(*d*), then only a single cloth 3*a* which is positioned at the uppermost position of the pile is separated from the remaining cloths 3. Thereafter, the cloth gripping devices 1 are moved along the guide cases 6 to predetermined positions above the sewing machine table 5. Subsequently, at the predetermined positions the air cylinders CY1 are operated to expand themselves to lower the cloth gripping devices 1. Thereafter, the air cylinders CY2 are operated to expand themselves to retract the claw members 10, then the cloth 3*a* will be released from the cloth gripping devices 1 and thus supplied onto the sewing machine table 5. It is to be noted that since the lower end portions 10*a* of the claw members 10 protrude slightly below the pressing faces 12, even the last cloth 3 can be gripped assuredly.

Figure 6:
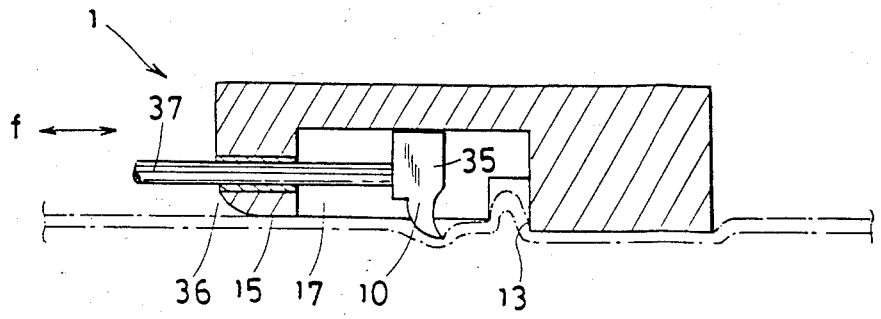
FIGS. 6 and 7 are cross-sectional views showing different embodiments of the present invention.
Figure 7:
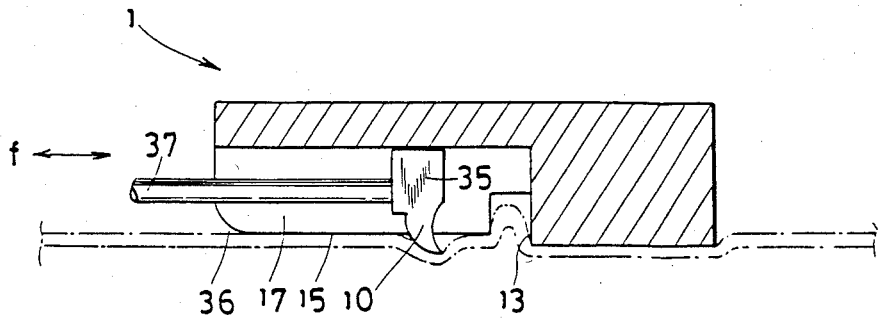

FIGS. 6 and 7 illustrate different embodiments of a cloth gripping device 1 according to the present invention wherein guide grooves 17 are provided each having a depth sufficient to receive and guide an upper portion 35 of a claw member 10 therein on opposite sides of a retracted face 15. The guide grooves 17 extend from an end border 36 or from a portion adjacent an end border 36 of the retracted face 15 so that the claw member 10 may be moved toward and away from a gripping wall 13, for example, by a reciprocating motion of an operating stem 37 in a direction as indicated by an arrow f.

It is to be noted that, in the cloth gripping device according to the present invention, the size and shape of the lower end portion 10*a* of the claw member 10 are not limited to those of any of the embodiments shown and described. The only requirement is that a single cloth to be gripped is allowed to be bitten by the lower end portion of the claw member. Thus, the lower end portion of the claw member may be made rough or uneven only if it does not damage cloth. Further, although it is quite necessary that the claw section 30 of the claw member 10 should protrude, to say the least, below the retracted face 15, the said protrusion should have, according to the thickness and the softness of the cloth to be gripped, such an extent that the claw section 30 is bitten into the cloth sufficiently to allow movement of the portion 33 of the cloth to be folded toward the gripping wall 13. It is further to be noted that several cloth pressing members 9 which are different from each other in width and depth of gripping grooves 21 and claw members 10, which individually correspond to the particular cloth pressing members 9, are prepared in advance so that they may be selectively used. In addition, the number of the guide grooves 17 formed in the cloth pressing member 9 may otherwise be one or any suitable number greater than two.

Since the present invention is characterized by the construction as described hereinabove, cloths accumulated in a pile can be assuredly gripped one by one from the top of the pile without being damaged and can thus be moved to a desired location. Hence, even when a cloth is to be displaced to another position, it can be displaced assuredly without being damaged. Thus, the cloth gripping device of the present invention is very advantageous to automation in a sewing process.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A cloth gripping device comprising:

a pressing member including a portion for pressing a cloth to grip the same and a claw member for cooperating with said pressing member to grip the cloth therebetween;

said pressing member having formed on a bottom thereof a pressing face located in a first plane for pressing the cloth;

a retracted face located in a second plane at a different elevation relative to said first plane, said different elevation corresponding to the thickness of a single cloth positioned in engagement with said retracted face, so that the space between said first and second planes is designed to accommodate only a single cloth;

a substantially vertical gripping wall provided by a step between said pressing face and said retracted face; and a gripping groove having a predetermined width for receiving a bent portion of a single cloth therein when only one single cloth is picked up adjacent a boundary between said pressing face and said retracted face, said gripping groove being juxtaposed between said pressing face and said retracted face;

said retracted face having a guide groove formed therein for guiding said claw member toward said gripping groove;

said claw member being disposed for reciprocal movement in a direction toward said gripping wall along said guide groove whereby only one cloth can be gripped between said claw member and said gripping wall.

2. A cloth gripping device according to claim 1, wherein two claw members are mounted for reciprocation relative to said pressing member for gripping a cloth within said gripping groove.

3. A cloth gripping device according to claim 2, wherein a plurality of retracted faces are provided adjacent to said pressing member and said claws are operatively positioned between adjacent retracted faces for reciprocation relative to said pressing member.

4. A cloth gripping device according to claim 1, and further including air supply means for assisting in discharging a single cloth at a predetermined location.

5. A cloth gripping device according to claim 1, and further including a guide rod on which said claw member is mounted for guiding the reciprocation of the claw member relative to the pressing member.

* * * * *